US008027616B2

(12) United States Patent
Mori

(10) Patent No.: US 8,027,616 B2
(45) Date of Patent: Sep. 27, 2011

(54) BELT UNIT AND IMAGE FORMING APPARATUS

(75) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/629,327

(22) Filed: Dec. 2, 2009

(65) Prior Publication Data

US 2010/0135704 A1 Jun. 3, 2010

(30) Foreign Application Priority Data

Dec. 2, 2008 (JP) ..... 2008-307849

(51) Int. Cl.
*G03G 15/16* (2006.01)

(52) U.S. Cl. ..... 399/121; 399/299

(58) Field of Classification Search ..... 399/121, 399/299, 303, 313
See application file for complete search history.

(56) References Cited

U.S. PATENT DOCUMENTS

| | | | | |
|---|---|---|---|---|
| 7,274,897 | B2 | 9/2007 | Katoh | |
| 7,310,488 | B2 | 12/2007 | Kitamura | |
| 7,369,793 | B2 | 5/2008 | Kumazawa | |
| 2007/0253754 | A1 | 11/2007 | Kobayashi et al. | |
| 2008/0138112 | A1 * | 6/2008 | Nakashima | 399/121 |
| 2008/0145114 | A1 * | 6/2008 | Furukawa et al. | 399/308 |

FOREIGN PATENT DOCUMENTS

| | | | |
|---|---|---|---|
| JP | H10-017174 | A | 1/1998 |
| JP | H11-157691 | A | 6/1999 |
| JP | 2003-076216 | A | 3/2003 |
| JP | 2004-117543 | A | 4/2004 |
| JP | 2005-140816 | A | 6/2005 |
| JP | 2005-170614 | A | 6/2005 |
| JP | 2005-189664 | A | 7/2005 |
| JP | 2005-195724 | A | 7/2005 |
| JP | 2005-321556 | A | 11/2005 |
| JP | 2006-243038 | A | 9/2006 |
| JP | 2007-298709 | A | 11/2007 |
| JP | 2007-298807 | A | 11/2007 |
| JP | 2008-152029 | A * | 7/2008 |

OTHER PUBLICATIONS

Japan Patent Office, Notification of Reasons for Refusal for Japanese Patent Application No. 2008-307849 (counterpart to above-captioned patent application), dispatched Nov. 24, 2010.

* cited by examiner

*Primary Examiner* — Sophia S Chen
(74) *Attorney, Agent, or Firm* — Baker Botts L.L.P.

(57) ABSTRACT

A belt unit includes: a pair of roller members spaced from and opposing each other in a first direction, each of the roller members having an axis extending in a second direction; an endless belt extending around the roller members; a plurality of transfer members arranged along the first direction between the roller members and spaced from one another so as to be enclosed by the endless belt; and a frame that rotatably supports the roller members and the transfer members. The frame includes: a pair of resin side frames spaced from each other in the second direction, each of the resin side frames extending in the first direction; and a resin bridging beam extending between the side frames.

13 Claims, 6 Drawing Sheets

BELT UNIT AND IMAGE FORMING APPARATUS

CROSS-REFERENCE TO RELATED APPLICATIONS

This application claims priority from Japanese Patent Application No. 2008-307849 filed on Dec. 2, 2008, the entire contents of which are incorporated herein by reference.

TECHNICAL FIELD

The present invention relates to an image forming apparatus, such as an electrophotographic color printer, and a belt unit attached to the image forming apparatus.

BACKGROUND

A so-called tandem color laser printer includes a plurality of photosensitive drums which correspond to respective colors, e.g., yellow, magenta, cyan, and black, and which are arranged in tandem side by side in a horizontal direction.

The tandem color laser printer includes a transfer unit disposed opposing the photosensitive drums and configured to transfer toner images formed on the photosensitive drums to a sheet during a conveyance of the sheet.

For example, the transfer unit is provided with a housing formed of metal plate that is disposed within a conveyor belt extending between a drive roller and a driven roller, and the housing holds transfer rollers opposing respective photosensitive drums.

SUMMARY

The above-described transfer unit includes the housing formed of metal plate.

Therefore, the transfer rollers can be supported with superior positional accuracy by means of high rigidity of the housing.

However, if a positional error of an attachment area for the transfer unit in a main unit occurs, since the housing hardly deforms for reasons of its high rigidity, it is difficult to allow the transfer rollers to uniformly contact the respective photosensitive drums.

If the transfer rollers unevenly contact the respective photosensitive drums, it will become difficult to enhance image accuracy of the image forming apparatus.

An object of the present invention is to provide a belt unit that can support all transfer members with superior positional accuracy and can also allow all of the transfer members to uniformly contact all photosensitive elements, as well as providing an image forming apparatus including the belt unit.

According to an aspect of the invention, there is provided a belt unit comprising: a pair of roller members spaced from and opposing each other in a first direction, each of the roller members having an axis extending in a second direction; an endless belt extending around the roller members; a plurality of transfer members arranged along the first direction between the roller members and spaced from one another so as to be enclosed by the endless belt; and a frame that rotatably supports the roller members and the transfer members, wherein the frame comprises: a pair of resin side frames spaced from each other in the second direction, each of the resin side frames extending in the first direction; and a resin bridging beam extending between the side frames and integrally formed with the side frames.

According to another aspect of the invention, there is provided an image forming apparatus comprising a belt unit, wherein the belt unit comprising: a pair of roller members spaced from and opposing each other in a first direction, each of the roller members having an axis extending in a second direction; an endless belt extending around the roller members; a plurality of transfer members arranged along the first direction between the roller members and spaced from one another so as to be enclosed by the endless belt; and a frame that rotatably supports the roller members and the transfer members, wherein the frame comprises: a pair of resin side frames spaced from each other in the second direction, each of the resin side frames extending in the first direction; and a resin bridging beam extending between the side frames and integrally formed with the side frames.

BRIEF DESCRIPTION OF DRAWINGS

FIGS. 5A and 5B are diagrams for explaining how the transfer unit is supported within a main unit casing, in which FIG. 5A is a right side view and FIG. 5B is a left side view.

DESCRIPTION

1. Overall Configuration of a Printer

Figure 1:
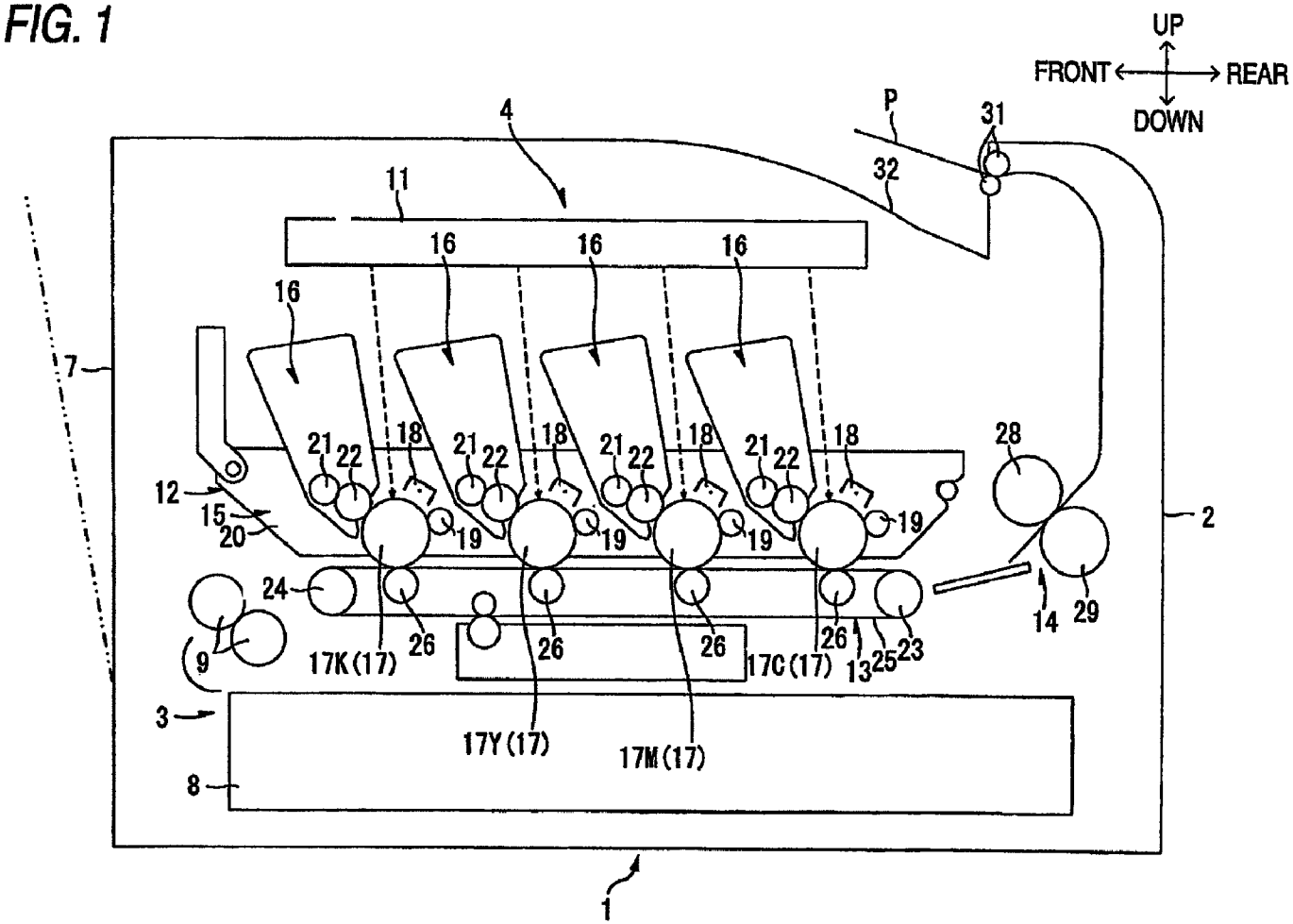
FIG. 1 is a side cross-sectional view showing a printer serving as an example image forming apparatus according to an embodiment of the invention.

An embodiment of the present invention will be described with reference to FIGS. 1 to 5B. A printer 1 is shown in FIG. 1 as an example of an image forming apparatus according to an embodiment of the preset invention. For ease of discussion, in the following description, directions are defined as viewed from a user who operates the printer 1. The top or upper side, the bottom or lower side, the left or left side, the right or right side, the front or front side, and the rear or rear side of the printer 1 are identified as indicated by the arrows in drawings. Further, herein the left-right direction is also referred to as a width direction or a lateral direction. With regard to various individual components of the printer 1, sides of the individual components are similarly identified based on the arranged/attached position of the components on/in the printer 1.

As shown in FIG. 1, the printer 1 is a horizontal-type tandem color laser printer. The printer 1 includes a main unit casing 2, and the main unit casing 2 stores therein a sheet feeding unit 3 configured to feed a sheet P and an image forming unit 4 for forming an image on the sheet P fed from the sheet feeding unit 3.

(1) Main Unit Casing

The main unit casing 2 has a box shape which is substantially rectangular in side view and which stores the image forming unit 4. A front sidewall of the main unit casing 2 contains a front cover 7 which is provided for removable attachment of a process unit 12. The front cover 7 is movable between an open position and a closed position.

(2) Sheet Feeding Unit

The sheet feeding unit 3 includes a sheet feeding tray 8 configured to store sheets P. The sheet feeding tray 8 is removably attached to a bottom area in the main unit casing 2. Above a front end of the sheet feeding tray 8, a sheet feeding roller (not shown) is disposed. At the rear side of the sheet feeding roller (not shown), registration rollers 9 are disposed.

The sheets P stored in the sheet feeding tray 8 are fed one at a time toward the registration rollers 9 by rotation of the sheet feeding roller (not shown). Subsequently, the sheet P is conveyed toward the image forming unit 4 (specifically between a plurality of, e.g., four, photosensitive drums 17 and a conveyance belt 25) by means of the registration rollers 9.

(3) Image Forming Unit

The image forming unit 4 includes a scanner unit 11, a process unit 12, a transfer unit 13 serving as an example of a belt unit, and a fixing unit 14.

(3-1) Scanner Unit

The scanner unit 11 is disposed in an upper portion of the main unit casing 2. As indicated by a broken line in FIG. 1, the scanner unit 11 emits laser beams based on image data toward the four photosensitive drums 17, thereby exposing the photosensitive drums 17.

(3-2) Process Unit

The process unit 12 is disposed at a position below the scanner unit 11 and above the sheet feeding unit 3. The process unit 12 includes one drum unit 15 and a plurality of, e.g., four, developer cartridges 16 corresponding to respective colors. The process unit 12 is movable along a front-rear direction so as to be inserted into and pulled out from an inside of the main body casing 2 when the front cover 7 is in the open position. Accordingly, the process unit 12 is removably attached to the main unit casing 2.

(3-2-1) Drum Unit

The drum unit 15 includes a drum frame 20, the four photosensitive drums 17 corresponding to respective colors, and a plurality of, e.g., four, scorotron chargers 18 and cleaning rollers 19 which both correspond to the respective photosensitive drums 17.

The drum frame 20 includes a pair of side plates disposed opposing each other and spaced from each other in the lateral direction.

The photosensitive drums 17 are arranged in parallel and spaced from each other in the front-rear direction. Further, the photosensitive drums 17 are rotatably supported between the side plates of the drum frame 20. Specifically, a black photosensitive drum 17K, a yellow photosensitive drum 17Y, a magenta photosensitive drum 17M, and a cyan photosensitive drum 17C are sequentially arranged from the front side toward the rear side.

The scorotron chargers 18 are disposed opposing and spaced from the respective photosensitive drums 17 at their obliquely upper rear positions.

The cleaning rollers 19 are disposed on the rear side of the respective photosensitive drums 17 so as to oppose and contact the respective photosensitive drums 17.

The scorotron chargers 18 and the cleaning rollers 19 are supported by a center frame (not shown) extending between the side plates of the drum frame 20.

(3-2-2) Developer Cartridge

The four developer cartridges 16 are removably attached to the drum unit 15 so as to correspond to the four photosensitive drums 17.

Each of the developer cartridges 16 includes a supply roller 21, a developing roller 22, and a layer thickness regulatory blade (not shown). Each of the developer cartridges 16 accommodates toner serving as a developing agent of a corresponding color.

(3-2-3) Developing Operation of the Process Unit

Toner accommodated in the developer cartridge 16 is supplied to the supply roller 21 and further to the developing roller 22, and then positively charged through friction between the supply roller 21 and the developing roller 22.

The thickness of the toner supplied to the developing roller 22 is regulated by a layer thickness regulatory blade (not shown) in association with rotation of the developing roller 22, and the toner is held on the surface of the developing roller 22 as a thin layer of given thickness.

Surfaces of the photosensitive drums 17 of the respective developer cartridges 16 are uniformly positively charged by the scorotron chargers 18 along with rotation of the respective photosensitive drums 17. Subsequently, the surfaces of the photosensitive drums 17 are exposed to laser beams (see broken lines in FIG. 1) originating from the scanner unit 11 through high speed scan. An electrostatic latent image corresponding to an image to be formed on the sheet P is thereby formed on the surfaces of the respective photosensitive drums 17.

When the photosensitive drums 17 further rotate, the positively-charged toner held on the surfaces of the developing rollers 22 is supplied to the electrostatic latent images formed on the respective surfaces of the photosensitive drums 17. The electrostatic latent images of the photosensitive drums 17 are thereby made visible, whereupon toner images formed by reversal development are held on the surfaces of the photosensitive drums 17 corresponding to the respective colors.

(3-3) Transfer Unit

The transfer unit 13 is disposed along the front-rear direction within the main unit casing 2 at a position above the sheet feeding unit 3 and at a position below the process unit 12. The transfer unit 13 includes: a drive roller 23 and a driven roller 24 which serve as an example of a pair of roller members; a conveyor belt 25 serving as an example of an endless belt; and a plurality of, e.g., four, transfer rollers 26 serving as an example of transfer members.

The drive roller 23 and the driven roller 24 are arranged to oppose and to be spaced from each other in the front-rear direction. The conveyor belt 25 includes an endless belt that passes around the drive roller 23 and the driven roller 24.

The transfer rollers 26 are provided in an inner space enclosed by the conveyor belt 25 between the drive roller 23 and the driven roller 24. The transfer rollers 26 are arranged in parallel and spaced from one another so as to oppose the respective photosensitive drums 17 with the conveyor belt 25 sandwiched therebetween.

The sheet P fed from the sheet feeding unit 3 is conveyed from the front side to the rear side by means of the conveyor belt 25 so as to sequentially pass through the space between each of the photosensitive drums 17 and a corresponding one of the transfer rollers 26. During conveyance of the sheet P, the toner images of respective colors held on the respective photosensitive drums 17 are sequentially transferred, thereby a color image is produced on the sheet P.

(3-4) Fixing Unit

A fixing unit 14 is arranged on the rear side of the transfer unit 13 and includes a heating roller 28 and a press roller 29 opposing the heating roller 28. In the transfer unit 13, the color image transferred to the sheet P is thermally fixed on the sheet P by heating and pressurization while the sheet P passes through the heating roller 28 and the press roller 29.

(4) Sheet Output

The sheet P having the toner image fixed thereon is conveyed toward sheet output rollers 31 and output on a sheet output tray 32 formed in an upper surface of the main unit casing 2 by means of the sheet output rollers 31.

2. Details of the Transfer Unit (1) Configuration of the Transfer Unit

Figure 2:
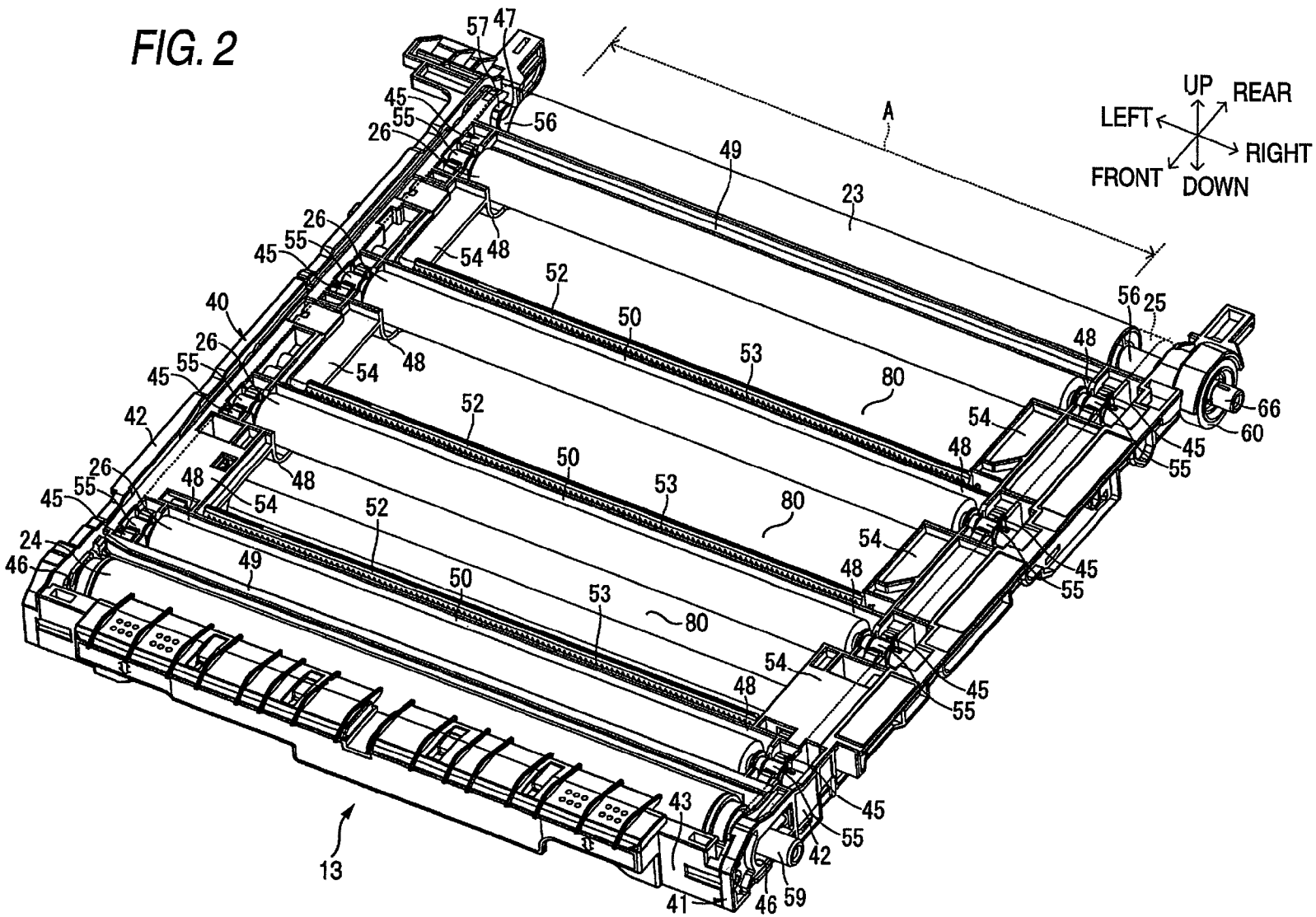
FIG. 2 is a perspective view showing a transfer unit shown in FIG. 1.

As shown in FIG. 2, the transfer unit 13 includes a frame 41, a front beam 43, the driver roller 23, the driven roller 24, the transfer rollers 26, and the conveyor belt 25.

The frame 41 contains hard resin, e.g., reinforced plastic, and integrally incorporates: a pair of side frames 40 which are laterally spaced and opposite each other; and first partition plates 49 serving as an example of bridging beams which extend between front and rear ends of the side frames 40. The frame 41 further integrally incorporates second partition plates 50 serving as an example of second partition members; contact prevention members 51 (see FIG. 3); and static charge eliminator support portions 52. Static charge eliminators 53 are further provided. In the frame 41, the side frames 40, the first partition plates 49, and the second partition plates 50 define a plurality of, e.g., three, wide rectangular openings 80 as shown in FIG. 2. The openings 80 are arranged in the front-rear direction and extend in the left-right direction.

Each of the side frames 40 integrally includes a side plate 42, bearing storing portions 45, and covering portions 48.

The side plate 42 has a flat plate shape extending in the front-rear direction. A first insert hole 46 is formed in a front end portion of the side plate 42, and a second insert hole 47 is formed in a rear end portion of the side plate 42.

The first insert hole 46 is an elongated hole extending along the front-rear direction in side view. The vertical length of the first insert hole 46 is slightly larger than the diameter of a driven roller bearing 59 (described later), such that the first insert hole 46 can accept the driven roller bearing 59.

The second insert hole 47 has a circular shape in side view, and the diameter of the second insert hole 47 is slightly larger than the diameter of a drive roller bearing 57 (described later). Accordingly, the second insert hole 47 can accept the drive roller bearing 57.

Each of the bearing storing portions 45 has a substantially box shape in plan view in which an upper side thereof is open. The number of the bearing storing portions 45 is four for each of the side frames 40, and the bearing storing portion 45 are arranged in parallel and spaced from one another in the front-rear direction.

The covering portions 48 are arranged adjacent to the respective bearing storing portions 45 and at an inside relative to the respective bearing storing portions 45. Each of the covering portions 48 has a substantially U shape in side view of which an upper end portion is open (see FIG. 3). An upper edge of each of the covering portions 48 is opened such that an opened length is slightly longer than the diameter of a sponge 62 (which will be described later) of the transfer roller 26 in the front-rear direction. Accordingly, each of the covering portions 48 can accept a lateral end of a corresponding sponge 62 (described later). The adjacent covering portions 48 are joined in the front-rear direction by means of a joint plate 54.

The first partition plates 49 are placed at a front end portion and a rear end portion of the frame 41 and extend between the side plates 42 of both side frames 40. The front first partition plate 49 is arranged between the driven roller 24 and the foremost transfer roller 26 and extends along the axial direction of the transfer roller 26, thereby separating the driven roller 24 from the foremost transfer roller 26. The rear first partition plate 49 is interposed between the drive roller 23 and the rearmost transfer roller 26 so as to extend in the axial direction of the transfer roller 26, thereby separating the drive roller 23 from the rearmost transfer roller 26. Specifically, the first partition plates 49 also function as first partition members.

The three second partition plates 50 are provided so as to separate the transfer rollers 26 from one another. The second partition plates 50 are positioned immediately behind the first, second, and third transfer rollers 26 from the front side, so as to oppose the respective transfer rollers 26. The second partition plates 50 extend along the axial direction of the respective transfer rollers 26 and stretch between the corresponding covering portions 48.

Figure 3:
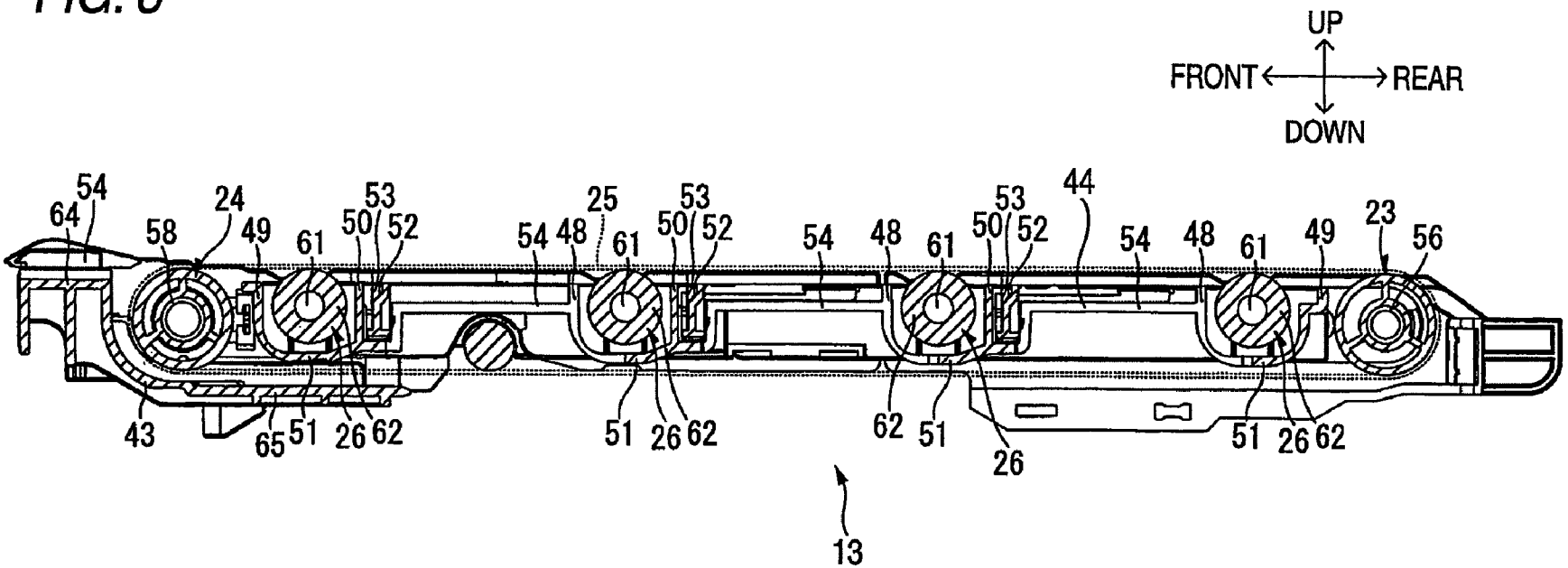
FIG. 3 is a side cross-sectional view corresponding to FIG. 2.

As shown in FIG. 3, the contact prevention members 51 are positioned below the respective transfer rollers 26. Each contact prevention member 51 extends between the corresponding covering portions 48. The foremost contact prevention member 51 is formed over the entire lower end portion of each of the foremost covering portions 48 so as to continually extend between the first partition plate 49 and the foremost second partition plate 50. Each of the other contact prevention members 51 is formed over about half of a rear portion of the lower end of each covering portion 48 so as to continually extend to the first partition plate 49 or the second partition plate 50.

The static charge eliminator support portions 52 are provided on the respective second partition plates 50 at a portion immediately rear side of the second partition plates 50. Each of the static charge eliminator support portions 52 extends in parallel with the corresponding second partition plate 50 and has a substantially U shape of which an upper side is open in side cross section.

Each of the static charge eliminators 53 is formed from metal and into a flat plate whose upper edge is sawtooth. The static charge eliminators 53 are laid in the respective static charge eliminator support portions 52 along the lateral direction.

As shown in FIG. 3, the front beam 43 integrally includes a front portion 64 and a rear potion 65 continuously extending from a lower edge of the front portion 64. The front portion 64 is disposed at the front of the driven roller 24 and having a substantially C shape whose lower side is open in side cross section. The rear portion 65 rearwardly extends in a curved manner from the lower edge of the front portion 64, and covers the front end of the driven roller 24 and the front end of the frame 41 from below.

The front portion 64 is spaced from the driven roller 24 in the front-rear direction to so as to allow the conveyor belt 25 (indicated by a dotted double line in FIG. 3) to pass therebetween.

The rear portion 65 is vertically spaced from the driven roller 24 and a support frame member 44 so as to allow the conveyance belt 25 to pass therebetween. The support frame member 44 includes the covering portions 48, the joint portions 54, the first partition plates 49, and the second partition plates 50.

The drive roller 23 is a metal pipe extending in the lateral direction and having a diameter longer than the vertical length of the support frame member 44. A resin coating layer is provided around an outer circumferential surface of the drive roller 23, and a metal drive roller shaft 56 is inserted in the center of the drive roller 23 along the lateral direction. As shown in FIG. 2, the drive roller 23 includes drive roller bearings 57, a gear 60, and a collar 66.

The drive roller shaft 56 has a lateral length so as to extend outside from both side plates 42 in the lateral direction. The drive roller shaft 56 supports the drive roller 23.

The drive roller bearings 57 contain resin so as to be able to fit into the second insert holes 47 of both side plates 42, and both ends of the drive roller shaft 56 are inserted into the respective drive roller bearings 57 so as to allow a relative rotation.

The gear 60 is placed on the right side of the right side plate 42 and fitted to a right end of the drive roller shaft 56 so as not to effect relative rotation. Drive force is input to the gear 60 from an unillustrated motor of the main unit casing 2.

The collar 66 contains resin and fitted to the right end of the drive roller shaft 56 on the right side of the gear 60 so as to allow a relative rotation.

The driven roller 24 is a metal pipe extending in the lateral direction and having the same diameter as that of the drive roller 23. A metal driven roller shaft 58 is inserted into the center of the driven roller 24 along the lateral direction. The driven roller 24 includes driven roller bearings 59.

The driven roller shaft 58 has substantially the same lateral length as that of the drive roller shaft 56. The driven roller shaft 58 supports the driven roller 24.

The driven roller bearings 59 contain resin so as to be able to fit into the first insert holes 46 of both side plates 42, and both ends of the driven roller shaft 58 are inserted into the respective driven roller bearings 59 so as to allow a relative rotation.

Each of the transfer rollers 26 includes a transfer roller shaft 61 serving as an example of a rotary shaft; the sponge 62 serving as an example of an elastic member; and bearings 55 serving as an example of bearing members.

The transfer roller shaft 61 contains metal and extends in the lateral direction. The transfer roller shaft 61 has a lateral length such that both ends of the shaft are arranged in the bearing storing portions 45 of both side plates 42.

The sponge 62 has a cylindrical shape and covers the transfer roller shaft 61 such that both ends of the transfer roller shaft 61 become exposed. Further, a diameter of the sponge 62 is made smaller than the diameter of the drive roller 23.

The bearings 55 contain resin and are inserted into both lateral ends of the transfer roller shaft 61 so as to allow a relative rotation, and support both lateral ends of the transfer roller shaft 61.

The conveyor belt 25 has a circumferential length such that the conveyor belt 25 can extend around the drive roller 23 and the driven roller 24. The conveyor belt 25 has a lateral length so as to extend between the outer ends of the bearing storing portions 45 in the lateral direction.

The driven roller bearings 59 of the driven roller 24 are fitted into the first insert holes 46 of both side plates 42 so as to protrude outside from the side plates 42. The drive roller bearings 57 of the drive roller 23 are fitted to the second insert holes 47 so as to protrude outside from both side plates 42.

The drive roller 23 and the driven roller 24 are thereby rotatably supported by the frame 41.

The bearings 55 of each of the transfer rollers 26 are fitted into the respective bearing storing portions 45.

Both lateral ends of each of the transfer roller shafts 61 are rotatably supported by the frame 41. The transfer rollers 26 are thereby rotatably supported by the frame 41. Both lateral ends of the sponge 62 of each of the transfer rollers 26 are received by the corresponding covering portions 48 from above. The lateral ends of the sponge 62 are thereby covered by the respective covering portions 48 from below.

The conveyor belt 25 encloses the transfer rollers 26 and the support frame member 44, and is passed around the drive roller 23 and the driven roller 24 so as to be situated between the front beam 43 and the driven roller 24 and between the front beam 43 and the support frame member 44.

An upper portion of the conveyor belt 25 contacts the transfer rollers 26 and the static charge eliminators 53, whilst a lower portion of the conveyor belt 25 is vertically separated from the covering portions 48 and the contact prevention members 51.

Specifically, each of the transfer rollers 26 contacts the upper portion of the conveyor belt 25 and is spaced from the lower portion of the conveyor belt 25. In other words, lower ends of the respective covering portions 48 and the respective contact prevention members 51 are interposed between the sponges 62 of the respective transfer rollers 26 and the lower portion of the conveyor belt 25.

When the conveyance belt 25 is projected in the vertical direction, both lateral ends of the conveyance belt 25 overlap the respective bearing storing portions 45.

Figure 4:
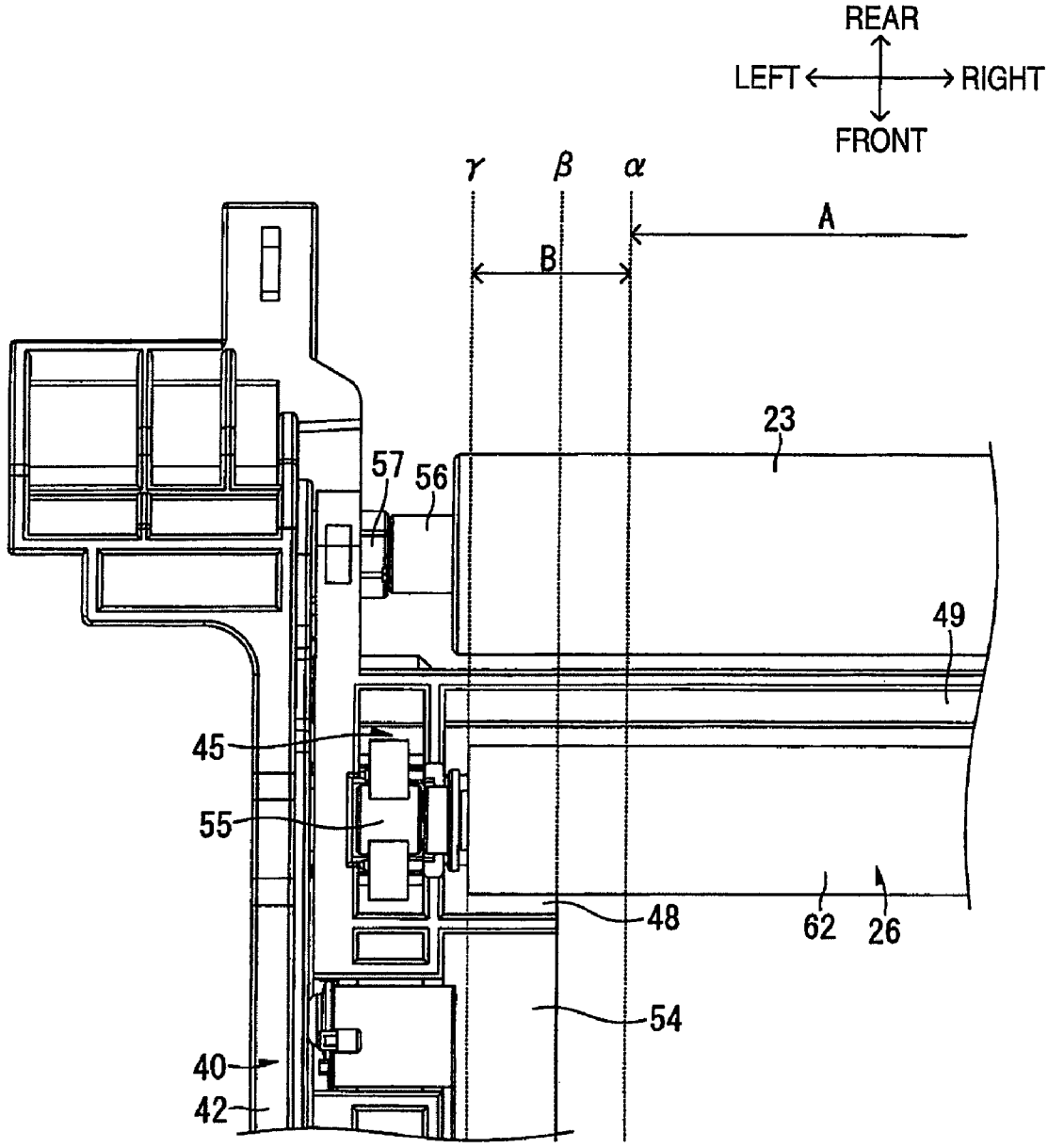
FIG. 4 is a diagram for showing an image transfer area.

As shown in FIG. 4, a lateral inner end of each of the side frames 40, i.e., a lateral inner end of each covering portion 48 and each joint portion 54, is aligned along a single line (as indicated by a dotted line β in FIG. 4) when viewed from above. Further, the lateral inner end is located within an area B in the lateral direction. The area B is located outside an image transfer area A (as indicated by a dotted line α in FIG. 4) in the lateral direction, but inside a lateral end of the sponge 62 of the transfer roller 26 (as indicated by a dotted line γ in FIG. 4).

The inner lateral end of each of the side frames 40 is located outside of the image transfer area A in the lateral direction. Consequently, the side frames 40 and the conveyor belt 25 can be prevented from contacting each other within the image transfer area A.

Accordingly, it is possible to prevent the static electricity at the conveyor belt 25 caused by a friction with the side frames 40 at the inside of the image transfer area A, so that occurrence of inconsistent transfer of an image can be prevented.

The inner lateral end of each of the side frames 40 is located inside relative to the lateral end of the sponge 62 of the transfer roller 26 in the lateral direction. Consequently, the covering portions 48 can receive paper dust resulting from the sponges 62 contacting the conveyor belt 25.

(2) Support of the Transfer Units

Figure 5A:
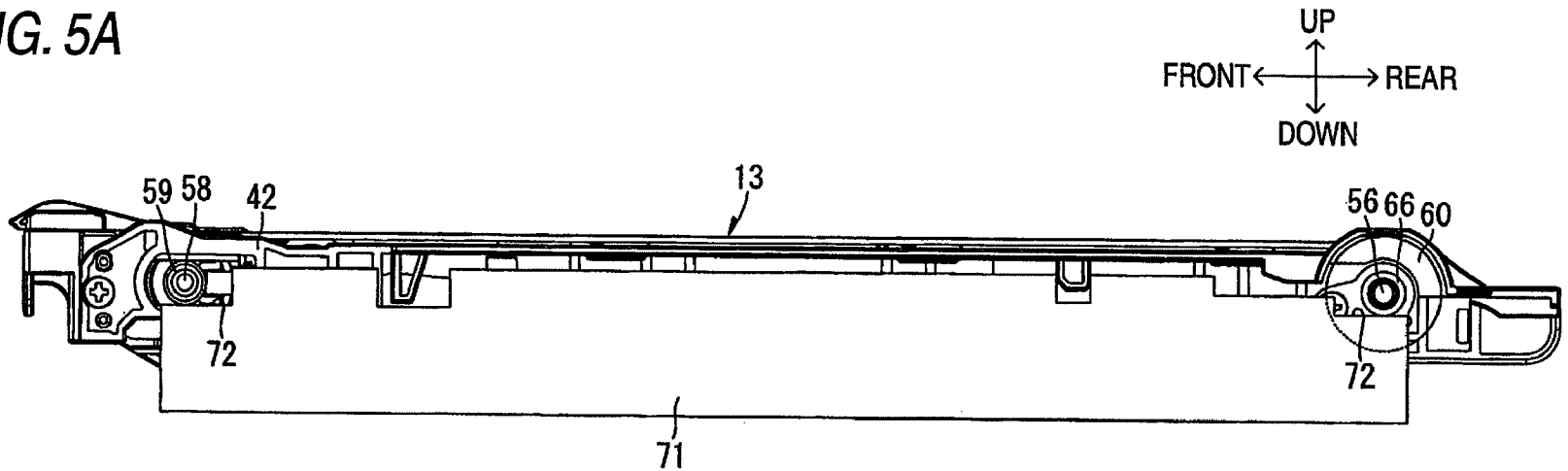
Figure 5B:
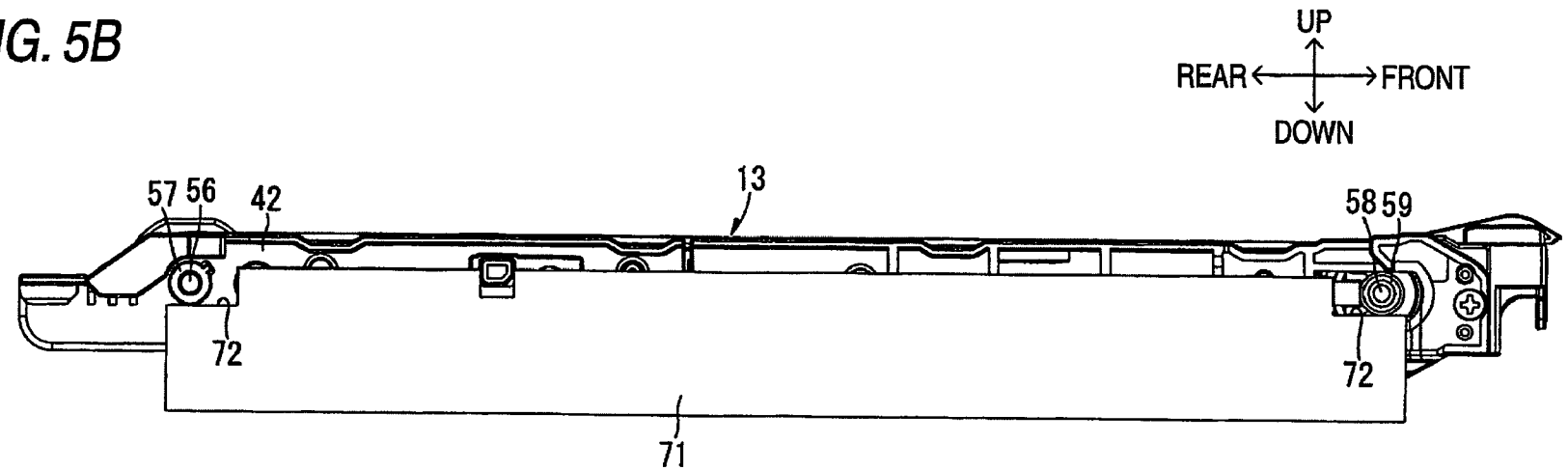

As shown in FIGS. 5A and 5B, a pair of support members 71 is disposed so as to oppose each other and is separated from each other at an interval such that the transfer unit 13 is sandwiched between the support members 71.

Each of the support members 71 is a flat plate having a length in the front-rear direction which is substantially identical with a gap between the drive roller shaft 56 and the driven roller shaft 58, and is arranged outside both of the side plates 42 and the gears 60 in the lateral direction. Each of the support members 71 has cutout portions 72.

The cutout portions 72 are respectively formed at both front and rear ends of each of the support members 71. All of the cutout portions 72 are downwardly cut from upper edges of the support members 71 so as to have substantially rectangular shapes having substantially same vertical length in side views.

The drive roller bearings 57 and the driven roller bearings 59 are fitted into the respective cutout portions 72 from above.

Accordingly, each of the side plates 42 are supported at two points, i.e., at the first insert hole 46 and the second insert hole 47, which are spaced from each other in the front-rear direction. That is, the transfer unit 13 is supported at two left points and two right points, i.e., a total of four points.

An error in the vertical length of the respective cutout portion 72 may occur. In such a case, only when the transfer unit 13 is placed on the support members 71, the transfer unit 13 is partially lifted from the support members 71. Therefore, the transfer unit 13 cannot be reliably supported at four points.

When the process unit 12 is attached to the main unit casing 2 in such a state, the respective photosensitive drums 17 are pressed against the transfer rollers 26 from above.

Accordingly, load imposed on the transfer unit 13 by the press force acts on the frame 41, and the frame 41 is deformed such that the frame 41 is supported by the cutout portions 72 at four points and that the transfer rollers 26 tightly contact the respective photosensitive drums 17.

As a result, the frame 41 is supported by the cutout portions 72 at four points, and the transfer rollers 26 can be uniformly pressed against the respective photosensitive drums 17. Further, the transfer rollers 26 can tightly contact the respective photosensitive drums 17.

Each of the side plates 42 has a shape standing upright in the vertical direction, which prevents deflection in the front-rear direction and the vertical direction. Consequently, when the front beam 43, the first partition plates 49, the second partition plates 50, and the contact prevention members 51 extending between the side plates 42 are appropriately deflected, the frame 41 becomes torsionally deformed.

Further, the main unit casing 2 includes an urging member (not shown) configured to forwardly urge both end portions of the driven roller 24 protruding from the side plates 42 in the lateral direction. Accordingly, the conveyor belt 25 is passed in tension around the drive roller 23 and the driven roller 24 such that a space is kept in the vertical direction.

When drive force is input to the gear 60, the drive roller 23 rotates, so that the conveyor belt 25 can be circularly rotated between the drive roller 23 and the driven roller 24.

Figure 6:
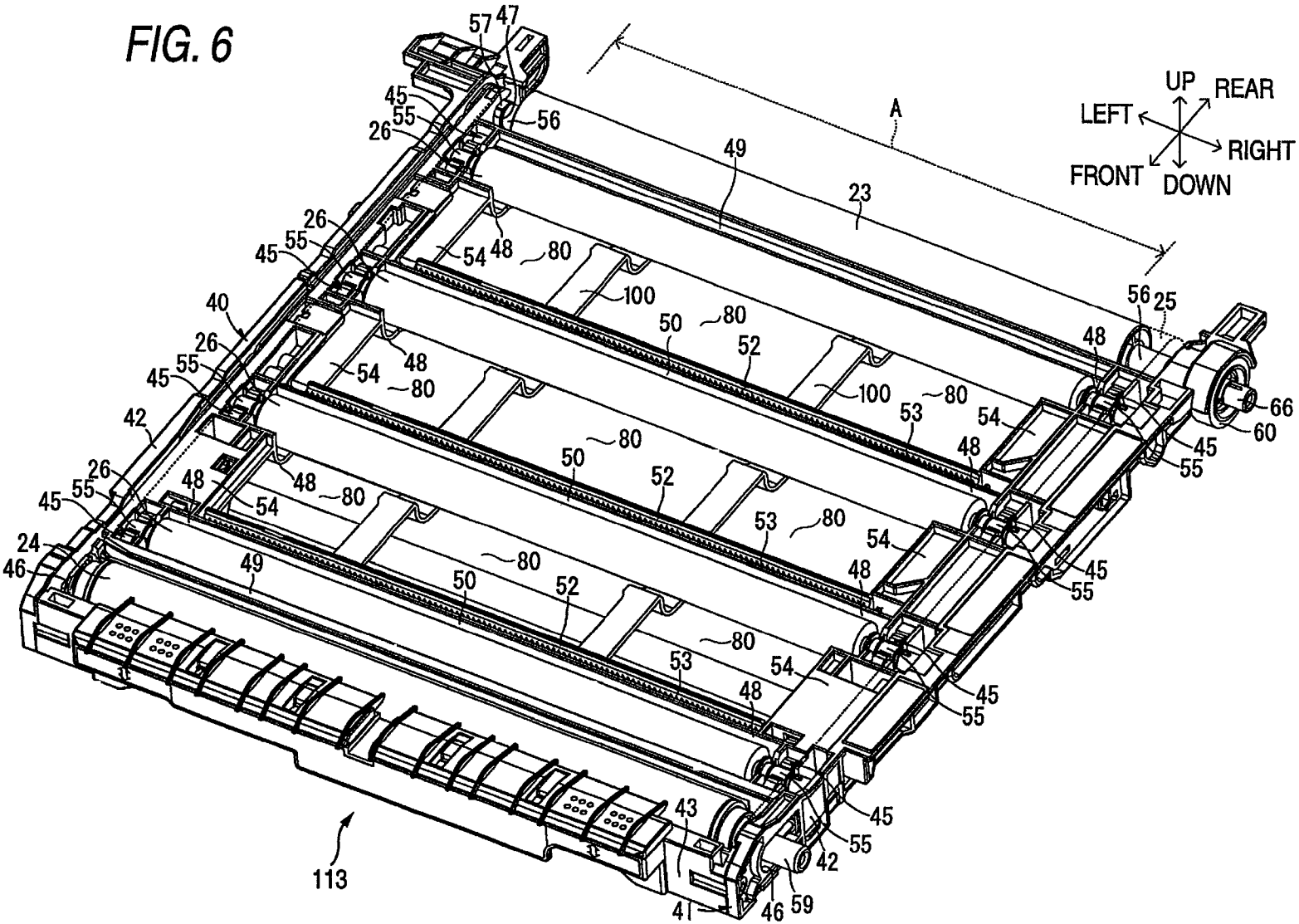
FIG. 6 is a perspective view showing a transfer unit according to another embodiment of the invention.

Another embodiment of the invention will be described with reference to FIG. 6. In FIG. 6, a transfer unit 113 is a variant of the transfer unit 13 of the above-described embodiment, parts substantially equivalent to those described above are denoted by the same reference numerals, and descriptions thereof will be omitted.

The transfer unit 113 includes a plurality of, e.g., two connecting portions 100. The connecting portions 100 extend in parallel with the side frames 40 and are spaced apart between the side frames 40. In the frame 41, the side frames 40, the first partition plates 49, the second partition plates 50, and the connecting portions 100 define a plurality of, e.g., nine, openings 80 in the frame 41. The openings 80 are arranged in the front-rear direction and the left-right direction. This configuration may improve dimensional accuracy of the transfer unit 113. Specifically, the connecting portions 100 may reduce warp or skew in the frame 41.

3. Effects and Advantages (1) In the transfer unit 13, the frame 41 integrally includes the resin side frames 40 and the resin first partition plates 49 extending between the side frames 40, as shown in FIG. 2.

Therefore, in the frame 41, the positional relationship of the side frames 40 is changed by the deflection of the first partition plates 49 such that arbitral parallel lines on the respective side frames 40 becomes skewed lines, without involvement of deterioration of rigidity of both side frames 40.

As a result, the front beam 43, the first partition plates 49, the second partition plates 50, and the contact prevention members 51 extending between both side plates 42 are deflected while the transfer rollers 26 are supported by the side frames 40 with ensured rigidity in the front-rear direction. Therefore, the frame 41 can be deformed while the transfer rollers 26 contact the respective photosensitive drums 17.

Accordingly, the transfer rollers 26 can be pressed against and tightly contact the respective photosensitive drums 17 by uniform press force with superior positional accuracy.

As a consequence, all of the transfer rollers 26 can be uniformly contact all of the photosensitive drums 17.

(2) Further, in the transfer unit 13, the first partition plates 49 extend between the corresponding front and rear ends of the side frames 40 as shown in FIG. 2.

Therefore, both front and rear ends of the side frames 40 can be fixed in the lateral direction. Accordingly, it is possible to prevent lateral deflection of both front and rear ends of the side frames 40 when the shape of the frame 41 is finely adjusted such that the transfer rollers 26 tightly contact the respective photosensitive drums 17.

Consequently, the respective transfer rollers 26 can be brought into contact with the respective photosensitive drums 17 more uniformly.

(3) According to the transfer unit 13, each of the transfer rollers 26 includes the transfer roller shaft 61, the sponge 62 which covers the transfer roller shaft 61, and the bearings 55 which support both ends of the transfer roller shaft 61. The bearing storing portions 45 storing the bearings 55 are integrally provided in the respective side frames 40.

Therefore, the transfer rollers 26 can be integrally supported by the side frames 40 while the rigidity of the side frames 40 in the front-rear direction is ensured.

As a result, even when the frame 41 is deformed such that the transfer rollers 26 contact the respective photosensitive drums 17, the positional accuracy of the transfer rollers 26 can be maintained in the front-rear direction.

As a result, the transfer rollers 26 can be pressed against the respective photosensitive drums 17 at uniform press force.

(4) As shown in FIG. 4, in the transfer unit 13, the side frames 40 are arranged outside of the image transfer area A.

If the side frames 40 are arranged inside of the image transfer area A, the side frame 40 may contact the conveyor belt 25 in the image transfer area A. Static electricity develops in a portion of the conveyor belt 25 contacting the side frame 40, and no static electricity develops in the remaining portion of the belt that does not contact the side frame 40. A resultant potential difference induces irregular image transfer.

However, in the transfer unit 13, the side frames 40 are disposed outside the image transfer area A, so that the side frames 40 can be prevented from contacting the conveyor belt 25 located in the image transfer area A.

Consequently, occurrence of irregular image transfer can be prevented.

(5) In the transfer unit 13, each of the side frames 40 includes the covering portions 48 which are located inside relative to the bearing storing portions 45 in the lateral direction, and positioned below the respective transfer rollers 26. Both lateral ends of each of the covering portions 48 are located inside relative to the corresponding sponge 62 in the lateral direction.

The sponges 62 contact the conveyor belt 25, which may cause dust from both ends of the conveyor belt 25. If the dust falls into the transfer unit 13, the dust may adhere to various locations in the transfer unit 13 along with driving operation of the transfer unit 13. If the dust adheres to the drive roller 23, the conveyance accuracy of the conveyor belt 25 may be deteriorated, or the surfaces of the transfer rollers 26 may be affected.

However, in the transfer unit 13, the covering portions 48 located below the respective sponges 62 can catch the dust.

Consequently, drop of dust of the sponges 62 onto the interior surface of conveyor belt 25 can be prevented. Therefore, it is possible to prevent an adhesion of dust to various locations in the transfer unit 13 during the course of circular rotation of the conveyance belt 25.

(6) In the transfer unit 13, the contact prevention members 51 are provided below the respective transfer rollers 26.

Therefore, the contact prevention members 51 can prevent the conveyance belt 25 from contacting the transfer rollers 26 at the positions below the transfer rollers 26.

(7) In the transfer unit 13, the first partition plates 49 are interposed between the drive roller 23 and an adjacent transfer roller 26, and between the driven roller 24 and an adjacent transfer roller 26, to thus double as the first partition members.

Therefore, when a transfer bias is applied to the transfer rollers 26, the first partition plates 49 can prevent leakage of a current from the transfer rollers 26 to the drive roller 23 and the driven roller 24.

(8) In the transfer unit 13, the second partition plates 50 are provided so as to oppose the respective transfer rollers 26.

Therefore, by use of the second partition plates 50, the static charge eliminators 53 can be provided in correspondence with the respective transfer rollers 26. The static charge eliminators 53 can make uniform the electric charge remaining on the conveyor belt 25 after image transfer.

As a consequence, local irregularities in electric charge in the conveyor belt 25 after image transfer can be prevented, so that an image can be transferred with superior accuracy.

(9) Further, the printer 1 includes the transfer unit 13 that yields the above advantages. Therefore, the transfer rollers 26 can uniformly contact the respective photosensitive drums 17, so that an image can be formed with superior accuracy.

(10) In the printer 1, each of the side plates 42 of the transfer unit 13 is supported at two points in the front-rear direction (in a direction in which the transfer rollers 26 are arranged).

Therefore, the frame 41 can be supported at a total of four points, and the transfer unit 13 can contact the respective photosensitive drums 17 more uniformly.

In the transfer unit 13, the frame 41 integrally includes the side frames 40 and the first and second partition plates 49 and 50 extending between the side frames 40, as shown in FIG. 2. However, the invention is not limited to such a configuration. The side frames 40 and the first and second partition plates 49 and 50 may be provided as separate pieces.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A belt unit comprising:

a pair of roller members spaced from and opposing each other in a first direction, each of the roller members having an axis extending in a second direction;

an endless belt extending around the roller members;

a plurality of transfer members arranged along the first direction between the roller members and spaced from one another, the transfer members being enclosed by the endless belt; and a frame that rotatably supports the roller members and the transfer members, wherein the frame comprises:

a pair of resin side frames spaced from each other in the second direction, each of the resin side frames extending in the first direction; and a resin bridging beam extending between the side frames, wherein each of the transfer members comprises:

a rotary shaft extending along the second direction;

an elastic member which covers the rotary shaft so as to expose axial end portions of the rotary shaft; and bearing members which support the axial end portions of the rotary shaft, respectively, and wherein each of the side frames comprises bearing storing portions configured to store the bearing members of the transfer members, the bearing storing portions being integrally formed in the side frame, wherein the side frames are arranged outside relative to an image transfer area in the second direction, the image transfer area being defined as a portion in which an image is transferred by the transfer members, wherein an upper portion of each of the transfer members contacts the endless belt, and wherein each of the side frames comprises covering portions arranged inside relative to the bearing storing portions in the second direction and arranged below the respective transfer members and outside the image transfer area, and wherein each of the covering portions is configured to cover an end portion of the elastic member.

2. The belt unit according to claim 1, wherein the side frames and the transfer members define a plurality of openings arranged in the first direction, each of the openings extending in the second direction.

3. The belt unit according to claim 1, wherein the frame further comprises a connecting portion extending in parallel with the side frames and disposed between the side frames.

4. The belt unit according to claim 3, wherein the side frames, the transfer members, and the connecting portion define a plurality of openings arranged in the first and second directions.

5. The belt unit according to claim 1, wherein the bridging beam is integrally formed with the side frames.

6. The belt unit according to claim 1, wherein the bridging beam comprises a first bridging beam and a second bridging beam, wherein each of the side frames extends from a first end portion thereof to a second end portion thereof in the first direction, and wherein the first bridging beam extends between the first end portions of the side frames, and the second bridging beam extends between the second end portions of the side frames.

7. The belt unit according to claim 1, further comprising contact prevention members provided below the respective transfer members, each of the contact prevention members extending between the corresponding covering portions of the side frames in the second direction.

8. The belt unit according to claim 1, further comprising a first partition member that separates one of the roller members from a corresponding one of the transfer members adjacent to the roller member.

9. The belt unit according to claim 1, further comprising a plurality of second partition members provided to oppose the respective transfer members and extending in the second direction.

10. An image forming apparatus comprising:

an image forming unit configured to form an image; and a belt unit, wherein the belt unit comprising:

a pair of roller members spaced from and opposing each other in a first direction, each of the roller members having an axis extending in a second direction;

an endless belt extending around the roller members;

a plurality of transfer members arranged along the first direction between the roller members and spaced from one another so as to be enclosed by the endless belt; and a frame that rotatably supports the roller members and the transfer members, wherein the frame comprises:

a pair of resin side frames spaced from each other in the second direction, each of the resin side frames extending in the first direction; and a resin bridging beam extending between the side frames and integrally formed with the side frames, wherein each of the transfer members comprises:

a rotary shaft extending along the second direction;

an elastic member which covers the rotary shaft so as to expose axial end portions of the rotary shaft; and bearing members which support the axial end portions of the rotary shaft, respectively, and wherein each of the side frames comprises bearing storing portions configured to store the bearing members of the transfer members, the bearing storing portions being integrally formed in the side frame, wherein the side frames are arranged outside relative to an image transfer area in the second direction, the image transfer area being defined as a portion in which an image is transferred by the transfer members, wherein an upper portion of each of the transfer members contacts the endless belt, and wherein each of the side frames comprises covering portions arranged inside relative to the bearing storing portions in the second direction and arranged below the respective transfer members and outside the image transfer area, and wherein each of the covering portions is configured to cover an end portion of the elastic member.

11. The image forming apparatus according to claim 10, further comprising a support member configured to support the belt unit such that each of the side frames is supported at two points separated from each other in the first direction.

12. The image forming apparatus according to claim 10, wherein the belt unit is disposed below the image forming unit.

13. A belt unit comprising:

a pair of roller members spaced from and opposing each other in a first direction, each of the roller members having an axis extending in a second direction;

an endless belt extending around the roller members;

a plurality of transfer members arranged along the first direction between the roller members and spaced from one another, the transfer members being enclosed by the endless belt; and a frame that rotatably supports the roller members and the transfer members, wherein the frame comprises:

a pair of resin side frames spaced from each other in the second direction, each of the resin side frames extending in the first direction; and a resin bridging beam extending between the side frames, wherein each of the transfer members comprises:

a rotary shaft extending along the second direction;

an elastic member which covers the rotary shaft so as to expose axial end portions of the rotary shaft; and bearing members which support the axial end portions of the rotary shaft, respectively, and wherein each of the side frames comprises bearing storing portions configured to store the bearing members of the transfer members, the bearing storing portions being integrally formed in the side frame, wherein the side frames are arranged outside relative to an image transfer area in the second direction, the image transfer area being defined as a portion in which an image is transferred by the transfer members, wherein an upper portion of each of the transfer members contacts the endless belt, and wherein each of the side frames comprises covering portions arranged inside relative to the bearing storing portions in the second direction and arranged below the respective transfer members and outside the image transfer area, and wherein each of the covering portions overlaps an end portion of the elastic member.

* * * * *